US007229312B2

(12) United States Patent
Jayne

(10) Patent No.: US 7,229,312 B2
(45) Date of Patent: Jun. 12, 2007

(54) TERMINAL BLOCK REAR CONNECTION BAR

(75) Inventor: Rob Jayne, Spokane, WA (US)

(73) Assignee: Telect, Inc., Liberty Lake, WA (US)

( * ) Notice: Subject to any disclaimer, the term of this patent is extended or adjusted under 35 U.S.C. 154(b) by 0 days.

(21) Appl. No.: 11/256,413

(22) Filed: Oct. 21, 2005

(65) Prior Publication Data

US 2007/0093125 A1 Apr. 26, 2007

(51) Int. Cl.
*H01R 13/60* (2006.01)

(52) U.S. Cl. ..... 439/532

(58) Field of Classification Search ..... 439/540.1, 439/532, 715, 716; 211/26
See application file for complete search history.

(56) References Cited

U.S. PATENT DOCUMENTS 3,915,541 A * 10/1975 Flegel ..... 439/540.1
4,496,057 A * 1/1985 Zenitani et al. ..... 211/26
4,591,949 A * 5/1986 Lahr ..... 361/731
5,567,178 A * 10/1996 Grasser ..... 439/532

* cited by examiner

*Primary Examiner*—Neil Abrams
(74) *Attorney, Agent, or Firm*—Lee & Hayes, PLLC

(57) ABSTRACT

Embodiments of a rear connection bar for a telecommunications terminal block are presented herein. In one or more embodiments, the rear connection bar is configured to secure at least a first and second size of connectors in a terminal block of a first depth when connected to the terminal block in different respective positions. The same rear connection bar may be configured to secure the first size of connectors in a second size terminal block when connected to the second terminal block in a first orientation, and to secure the second size of connectors while connected to the second terminal block in a reverse orientation.

13 Claims, 9 Drawing Sheets

TERMINAL BLOCK REAR CONNECTION BAR

FIELD OF THE INVENTION

The present disclosure relates to terminal blocks for mounting in a telecommunications equipment frame. More specifically, the disclosure relates to a terminal block rear connection bar that secures connectors in a terminal block.

BACKGROUND

Terminal blocks are used in telecommunications infrastructure to provide interconnections between various telecommunication equipment and devices. As such, terminal blocks may be used in a variety of sites within a telecommunications infrastructure and the design of a particular block may depend upon its application within the infrastructure.

Terminal blocks are typically mounted in a housing at a site within a telecommunications infrastructure, such as in a distribution frame at a central office site. Depending upon the application of a terminal block, different types or sizes of connectors may be provided. Industry standard 50 pin connectors or 64 pin connectors are commonly used. Typically, however, manufacturers design terminal blocks to fit a particular type or size connector. Further, a variety of terminal block sizes exist. For example, terminal blocks are typically designed in industry standard depths of 4.75 inches and 6.00 inches. Terminal block depth may be selected to match a certain distribution frame size or to match existing terminal blocks and/or other equipment of a particular customer. Thus, a typical manufacturer makes different individual designs for each of the different combinations of connectors and terminal block sizes, which thereby results in added complexity and cost.

SUMMARY

Rear connection bars utilized in telecommunications terminal blocks are described. The rear connection bars are connectable to different terminal blocks to secure different connectors. For example, a rear connection bar may be connected to the chassis of one terminal block having one size, in one or more positions, to secure different connectors. Different connectors may be of a different size (e.g., different length, width, height and so forth) and/or of a different type. The rear connection bar may also be connected to another terminal block having a different size, in one or more positions, to secure different connectors. Thus, a rear connection bar may be utilized in different terminal blocks to secure different connectors.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIGS. 2A to 2E illustrate an exemplary rear connection bar connectable in different configurations within different terminal blocks to secure at least two sizes of connectors in each terminal block.

DETAILED DESCRIPTION

It should be noted that the following devices are examples and may be further modified, combined and separated without departing from the spirit and scope thereof.

Figure 1:
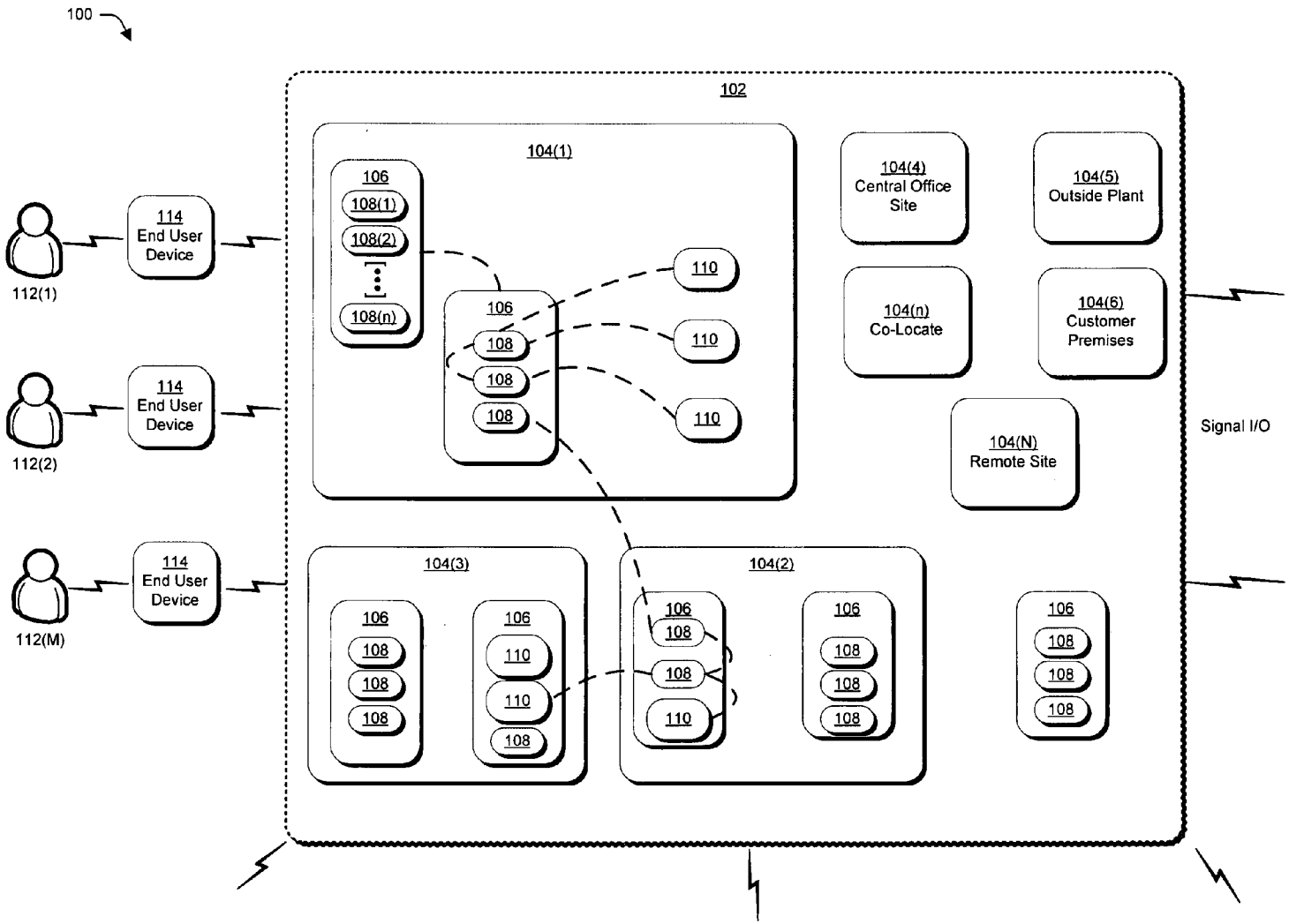
FIG. 1 is an illustration of an environment having a portion of a telecommunications infrastructure.

FIG. 1 illustrates an exemplary implementation of an environment 100 operable to provide a telecommunications network in which the apparatuses and procedures of the present disclosure may be employed. The environment 100 includes at least a portion of a telecommunication network infrastructure 102 (hereinafter "infrastructure"). Infrastructure 102 provides telecommunications processes, structures, equipment and devices between end-user devices such as modems, phones, and so on used by end-users outside of the infrastructure 102 to communicate via a telecommunications network. Within infrastructure 102 a variety of equipment, apparatus and devices are utilized in routing, processing, and distributing signals. Telecommunications signals and data may among other actions be processed, switched, routed, tested, patched, managed, or distributed by various equipment in the infrastructure 102.

A variety of sites 104(1)–104(N) within infrastructure 102 may maintain various equipment used in the infrastructure 102. As depicted in FIG. 1, infrastructure 102 may have numerous sites 104 which may be different physical locations within infrastructure 102 such as a central office, an outside plant site, a co-locate site, a remote site, or customer premises. Sites 104 may be locations within infrastructure 100 which hold a variety of structures and equipment to facilitate processing and distributing of telecommunications signals. The equipment may be centralized in one site (e.g., site 104(1)) or dispersed throughout different sites 104 in infrastructure 102. In other words, interconnections may be made between various sites 104 in infrastructure 102, for example the connection denoted in FIG. 1 by a dashed line between site 104(1) and 104(2). Naturally, numerous interconnections between a plurality of sites 104 typically may be made.

Each site 104 may have one or more housing 106 having a plurality of components 108. A housing refers to a structure to maintain or hold a plurality of components 108 in infrastructure 102 and may be configured in a variety of ways. For example, the housing 106 may be configured as a housing for a cabinet, a terminal block, a panel, a chassis, a digital cross-connect, a switch, a hub, a rack, a frame, a bay, a module, an enclosure, an aisle, or other structure for receiving and holding a plurality of components 108. Hereinafter, the terms housing and cabinet will be used for convenience to refer to the variety of structures in infrastructure 102 that may hold components 108. Housings 106 may be inside a building or housings may themselves be configured to be placed outside. Housings 106 may typically be configured to protect components 108 from environmental influences. The environment 100 of FIG. 1, for instance, depicts site 104(1) as having two housings (e.g. cabinets)

106, each having a plurality of components 108. Other housings 106 may be included throughout infrastructure 102 at sites 104, for example housings 106 depicted within site 104(2).

Components 108 are pieces of telecommunications equipment in infrastructure 102 that may be kept or maintained in a housing 106 (e.g. cabinet) within the infrastructure 102. Components for example may be cross-connect panels, modules, terminal blocks, chassis, backplanes, switches, digital radios, repeaters and so forth. Generally, components 108 may be those devices utilized for processing and distributing signals in infrastructure 102 and which may be maintained in a housing 104. Components 108 may also be used to manage cabling in infrastructure 102. Components 108 may terminate, interconnect or cross-connect a plurality of network elements 110 within infrastructure 102. Components 108 may be utilized to distribute telecommunications signals sent to and from infrastructure 102 by one or more end-users 112 using an end-user device 114. The interconnections between telecommunications equipment (e.g., cabinets 106, components 108 and network elements 110) provide signal pathways for telecommunications signals. Interconnection may be via one or more components 108 such as by connectors on a terminal block or may be internal to the components 108 such as via cabling within a component 108. Representative interconnections are shown by dashed lines in FIG. 1 and numerous interconnections within and between telecommunication equipment are typical.

Network elements 110 may be implemented in a variety of ways. For example, network elements 110 may be configured as switches, digital cross connect system (DCS), telecommunication panels, terminal blocks, digital radios, fiber optic equipment, network office terminating equipment, and any other telecommunication equipment or devices employed in a telecommunications infrastructure 102. It is noted that one or more of the components 108 within a cabinet 106 may also be a network element 110. In other words, network elements 110 may be found within a cabinet 106 as component 108 of the cabinet. Thus, in a particular cabinet 106 interconnections may be between network elements 110 externally (e.g., not in the same cabinet) or internally (e.g., within the same cabinet). Naturally, internal and external interconnections may be mixed such that a single cabinet 106 will have both internal and external interconnections. Further, such connections for a particular cabinet 106 might be made wholly within a particular site 104. Interconnections may also be made between a plurality of sites 104.

The environment 100 depicts a plurality of end users 112(1)–112(M) which may be communicatively coupled, one to another, via a telecommunication network including infrastructure 102. End users 112 may be implemented in a wide variety of ways, such as consumers, business users, internal users in a private network, and other types of users that use telecommunications signals or transmit and receive telecommunications signals. Additionally, for purposes of the following discussion clients 112(1)–112(M) may also refer to client devices and software which are operable to transmit and receive telecommunications signals. Thus, clients 112(1)–112(M) may be implemented as users, software and devices.

The interconnection of pieces of equipment (e.g. cabinets 106, components 108 and network elements 110, and so forth) provides signal pathways between equipment for signals input to and output from infrastructure 102. For example, end-users 112(1)–112(M) may send signals into the infrastructure 102 and receive signals output from the infrastructure using a variety of end user devices 114. For example, end user 112(2) may communicate with end user 112(M) via end-user device 114 (e.g., a telephone). Thus, signals sent to and from infrastructure by end-users 112 via an end user device 114, may be routed directed, processed, and distributed in a variety of ways via the equipment and interconnections within infrastructure 102.

In an implementation, one or more cabinets 106 may be configured as a distribution frame such as a main distribution frame (MDF) or intermediate distribution frame (IDF). A distribution frame has a plurality of components 108. Typically, components 108 in a distribution frame distribute telecommunications signals between network elements 110 within infrastructure 102 and between end-users 112. A distribution frame may provide a centralized interconnection point, for example in a telephone system which provides service to end-users 112, and having equipment for terminating and interconnecting end-user lines (e.g. subscribers). The distribution frame is used to connect end-users lines, one to another, or to connect end user lines through network elements 110 in infrastructure 102. The distribution frame in a site 104 may also holds protective devices and act as a test point between end-users 112 and equipment in infrastructure 102.

In an implementation, a cabinet 106 configured as a distribution frame has a plurality of components 108 to connect numerous lines. A cabinet 106 (e.g., a distribution frame) may have a plurality of components 108 configured as terminal blocks, as depicted in FIG. 1 by terminal blocks 108(1), 108(2), . . . , 108(*n*). Terminal blocks 108(1)–108(*n*) provide modular connection points within a cabinet 106 between end-user lines and between network elements 110 such as switches, cross-connects, other terminal blocks, and so forth. Naturally, terminal blocks 108(1)–108(*n*) are representative of numerous terminal blocks which may be found in numerous cabinets 106 within infrastructure 102.

End-users 112 may be connected via twisted pair cabling to terminal blocks 108(1)–108(*n*) in a cabinet 106 located within infrastructure 102. Further, end-users 112 may be connected via a plurality of network elements 110 which are connected via the various equipment in infrastructure 102, including the interconnections of a plurality of terminal blocks such as terminal blocks 108(1)–108(*n*). For example, an end-user telephone call made between end user 112(1) and end user 112(2) may be routed using one or more terminal blocks 108(1)–108(*n*) and/or a various network elements 110 within infrastructure 102.

FIGS. 2A to 2D depict exemplary embodiments of a terminal block 108(1) and 108(2) depicted in FIG. 1 in greater detail. Taken together FIGS. 2A to 2D depict configurations in which a rear connection bar 202 is utilized in terminal blocks 108(1)–108(2) having different sizes to secure at least two sizes of connectors in each of the terminal blocks 108(1)–108(2).

Figure 2A:
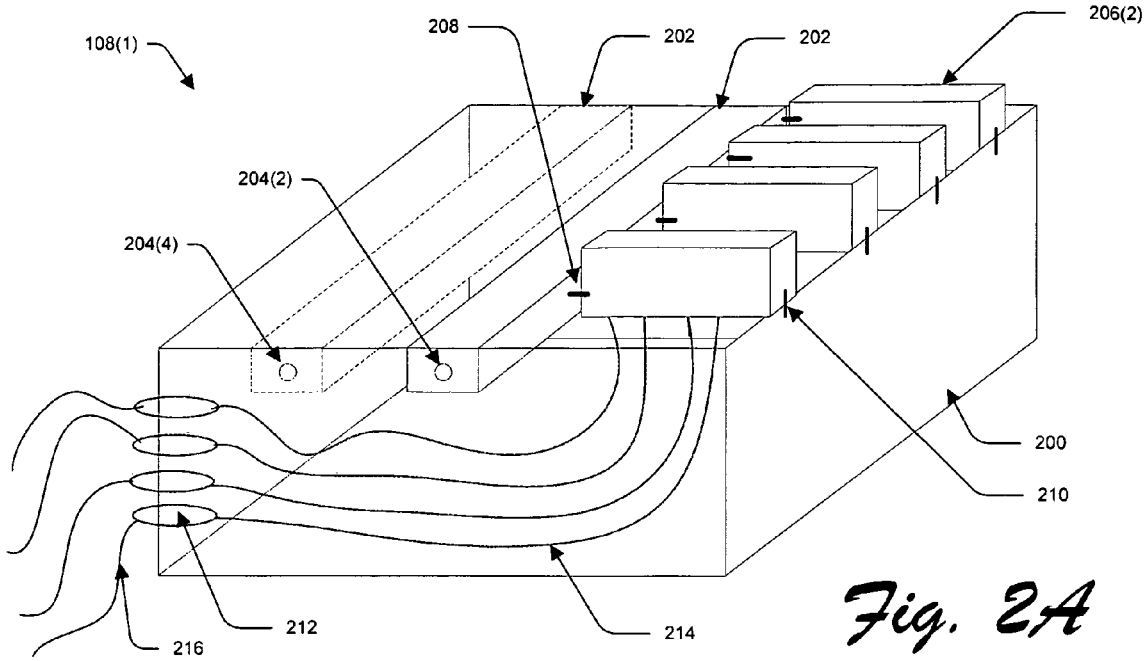

FIG. 2A depicts terminal block 108(1) having a chassis 200 and a rear connection bar 202. Chassis 200 has substantially a rectangular cross section and may be configured in a variety if ways. For example chassis 200 may be formed from a variety of materials such as plastic, metal and so forth. The interior of chassis 200 may be open, such as a box with an open end. The open interior of chassis 200 permits cabling, such as twisted pair cabling, to be run within the terminal block 108(1) to make connections to parts of the terminal block 108(1).

Rear connection bar 202 is connectable to the chassis 200. Rear connection bar 202, for instance, is connectable to chassis 200 at one or more positions 204 within the chassis 200 of the terminal block 108(1). A plurality of positions 204(2) and 204(4) within chassis 200 are depicted in FIG. 2A. For example, FIG. 2A depicts rear connection bar 202 connected at a first position 204(2). FIG. 2A further depicts that rear connection bar 202 may be connected in a second position 204(4) within chassis 200 (indicated by the rear connection bar drawn in phantom using dashed lines at position 204(4)).

The rear connection bar 202 extends across the terminal block 108(1) and is connectable to the terminal block 108(1). For example, rear connection bar 202 may be connected to chassis 200 of terminal block 108(1) at both ends using fasteners. Rear connection bar 202 may be connected to a terminal block such as terminal block 108(1) in a variety of ways, such as by using by removable fastening techniques such as screws, snaps, clips and so forth. Further rear connection bar 202 may be fixedly fastened to the chassis 200, for example by glue or welds. Rear connection bar 202 may also be slideably connected such that the rear connection bar 204 may slide between at least two positions, e.g. positions 204(2) and 204 (4), to accommodate different sizes connectors. Thus, rear connection bar 202 may be fastened and/or slid to a plurality of positions between positions 204(2) and 204(4) to accommodate a variety of connector sizes and/or connector mounting patterns.

Figure 2B:
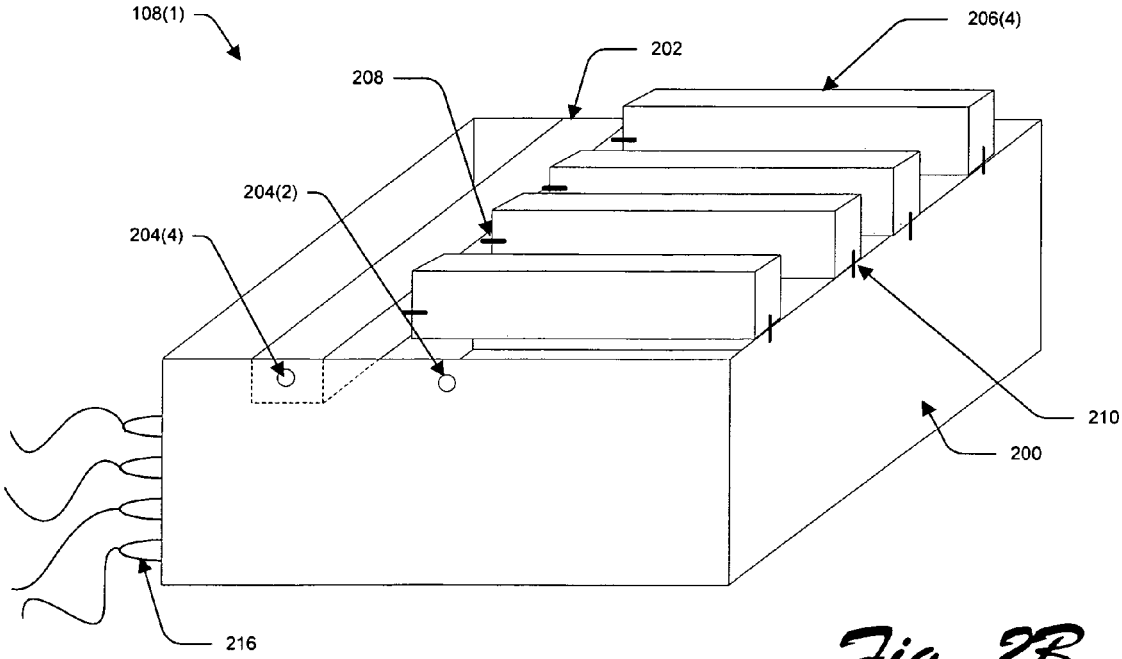

Rear connection bar 202 is further configured to secure different size connectors 206 in different sized terminal blocks. Connectors 206, as used herein, refer to a variety of connectors including connectors of a first size 206(2) as depicted in FIG. 2A and connectors of a second size 206(4) as depicted in FIG. 2B. Connectors 206 may be configured in a variety of ways. Different sized connectors may be of a different length, width, depth, height and so forth and/or of different types. Thus, first size connectors 206(2) may have a different length than second size connectors 206(4). The variety of connectors 206 may also be of different types. For example, the connectors 206 may be 50 pin or 64 pin type connectors commonly used in terminal blocks within a main distribution frame in the telecommunications industry. Connectors 206 may also be configured as various other types and sizes suitable for making interconnections of equipment (e.g. cabinets 106, components 108 and network elements 110) in a telecommunication infrastructure 102. Connectors 206, for instance, may be used to connect incoming signals lines from end-users 112 and/or network elements 110. Further, connectors 206 may be used to connect outgoing signal lines running to end-users 112 and/or network equipment 110. Typically, twisted pair cabling is used within a terminal block and main distribution frame (e.g., cabinet 106) to make such connections.

Reference is made now to FIGS. 2A and 2B together. FIGS. 2A and 2B depict the same terminal block 108(1) with the rear connection bar in different respective positions 204. In FIG. 2A, rear connection bar 202 is depicted as connected to chassis 200 in a first position 204(2) to secure connectors of a first size 206(2). In FIG. 2B rear connection bar 202 is depicted as connected at a second position 204(4) within the same terminal block 108(1). While connected in the second position 204(4) the rear connection bar may secure connectors of a second size 206(4). In this way, terminal block 108(1) may receive connectors 206 of different sizes.

Rear connection bar 202 is configured to receive one end of a connector 206 and to secure the one end of the connector 206 with a securing mechanism 208. Securing connectors 206 to a terminal block, such as terminal block 108(1) may be accomplished in a variety of ways. For example, rear connection bar 202 may have notches, slots, brackets, a shelf, and so forth to support one end of a connector 206. Further, an end of a connector 206 may rest upon the rear connection bar 202 without being secured.

Various securing mechanisms 208 may be used to secure a connector to rear connection bar 202. Securing mechanisms 208, for instance, may include fasteners such as screws, pins, clips, rivets, glue, snaps, bolts and so forth. For example, a connector 206 may have a hole disposed on an end that corresponds to a hole on the rear connection bar 202. Thus, a fastener (e.g., a screw) may be inserted through the hole in the connector 206 and the rear connection bar 202 to secure the connector 206 at that end.

The connector 206 may also be secured without fasteners, such as by "snapping in", interlocking, tabs and so forth. For example, the rear connection bar 202 may be configured with a plurality of tabs that receive a corresponding end of a connector 206 such that the connector 206 interlocks with the tab in the rear connection bar 302 and is thereby secured. The tabs may be depressed to release rear connection bar 302.

Another end of a connector 206 may be secured to the chassis 200 using other securing mechanisms 210. The securing mechanisms 210 may be configured in a variety of ways and may be the same or different than securing mechanisms 208. Various fasteners or interlocking designs, such as those described regarding securing mechanism 208, may be utilized to secure connectors 206 to the chassis 200. Connectors 206 may be supported on one end by the chassis 200. For example, a connector 206 may rest upon a wall of chassis 200. Chassis 200 may also have a shelf, a ridge, a bracket, molded receptors and so forth, integrated in to the chassis 200 or attached to the chassis, to receive an end of a connector 206. Thus, one end of a connector 206 may be secured to the rear connection bar 202 while the other end is secured to the chassis 200. In this manner, the connector 206 may be secured in the terminal block 108(1).

Connectors 206 within a terminal block may be connected to terminations 212 disposed upon the chassis 200. Terminations 212 provide cable connection points in a terminal block for signals into and out from the terminal block. Typically, an array of terminations 212 is disposed upon one side wall of chassis 200 such that the terminations 212 extend through chassis 200 and are supported by the chassis. Terminations 212 are connected via cabling 214, such as twisted pair cabling, in the interior of chassis 200 to connectors 206. Terminations 212 also connect via cabling 216, such as twisted pair cabling, on the exterior of chassis 200 to form interconnections of equipment within infrastructure 102. For example, one terminal block may be connected to another terminal block via cabling 216. In this manner network elements 110 or end-users 112 connected at each terminal block may be interconnected.

Figure 2C:
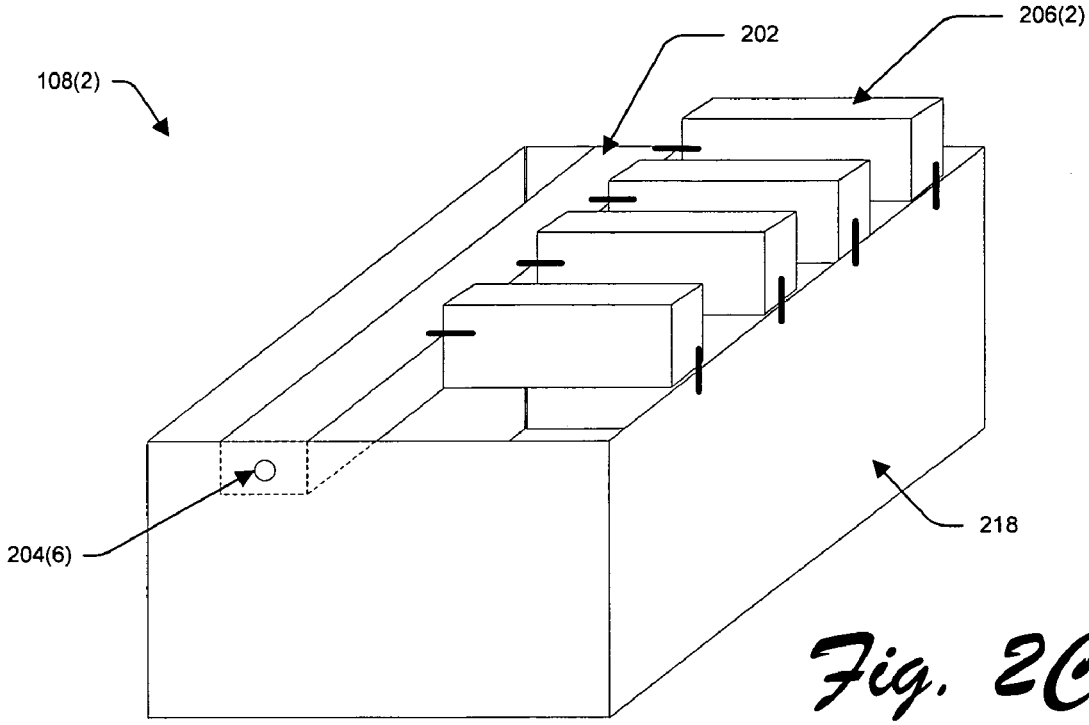
Figure 2D:
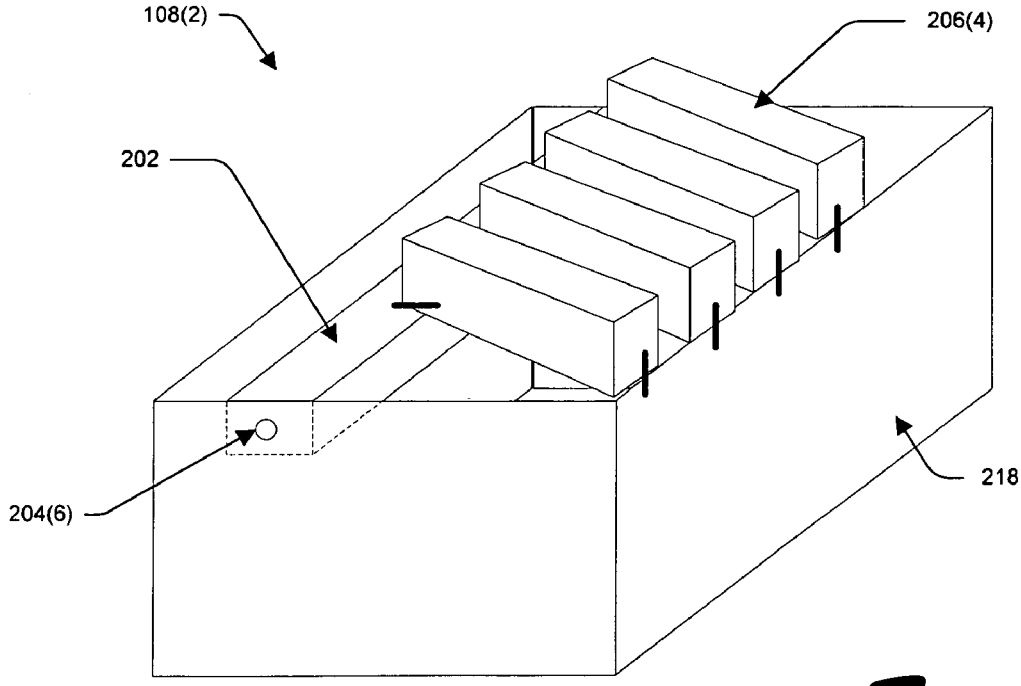
Figure 2B:
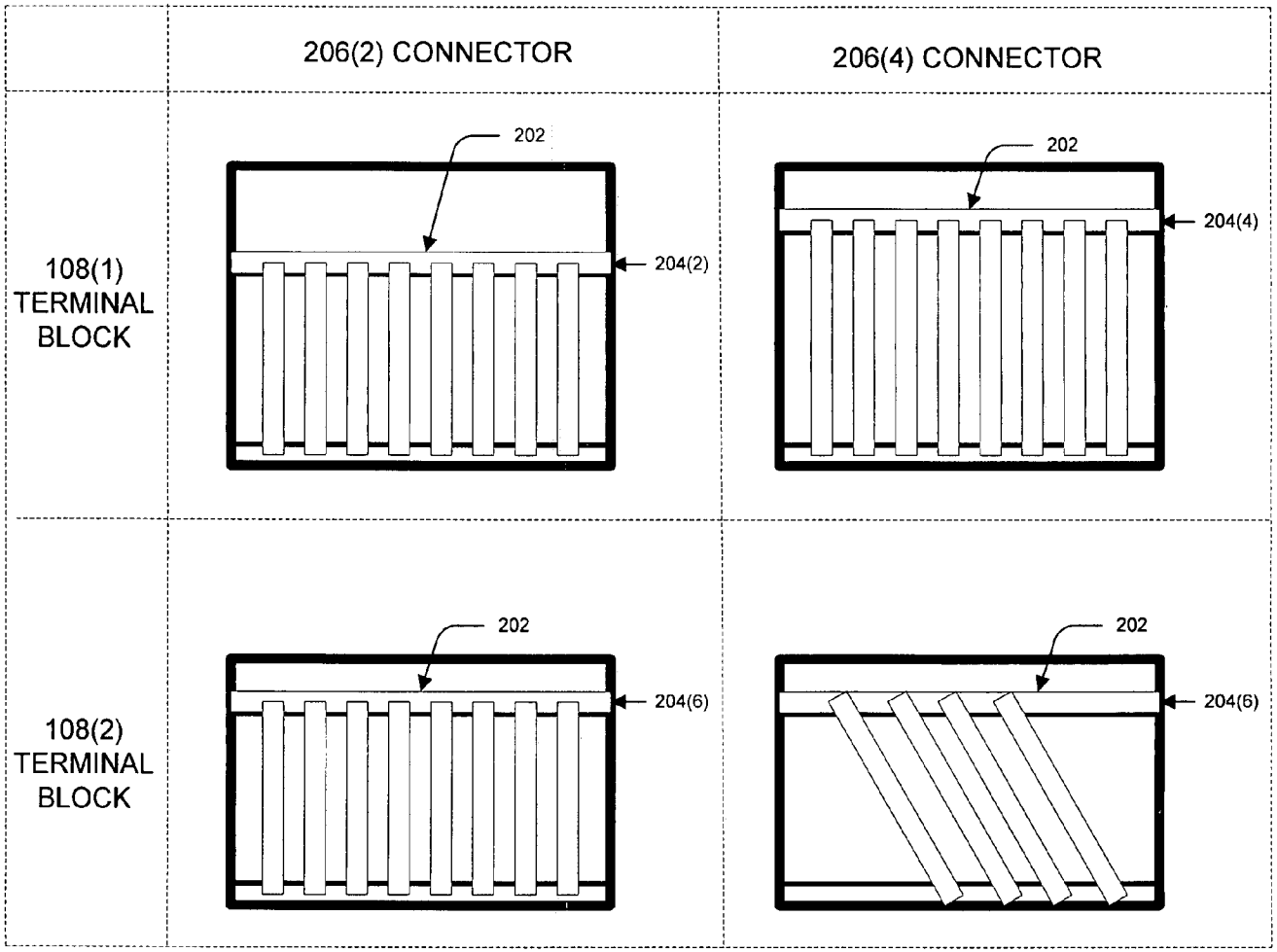

Reference is now made to FIGS. 2C and 2D together. FIGS. 2C and 2D each depict the same terminal block 108(2) with the rear connection bar 202 located in the same position 204(6). Terminal block 108(2) is a different sized terminal block than terminal block 108(1) depicted in FIGS. 2A and 2B. Thus, terminal block 108(2) has a chassis 218 with dimensions different than chassis 200. Dimension of both chassis 200 and 218 may correspond to standard sizes for terminal blocks and cabinets. For example, standard sizes of 6.00 inch and 4.75 inch terminal blocks are commonly used in telecommunications. Naturally, the apparatus and techniques described herein may be employed within standard and non-standard chassis alike.

In FIG. 2C, rear connection bar 202 is depicted as connected to chassis 218 in a position 204(6) to secure connectors of a first size 206(2). Naturally, connectors 206 may be secured and the rear connection bar 202 may be connected in any of the ways previously described. In FIG. 2D rear connection bar 202 is depicted as connected at the same position 204(6) within the same terminal block 108(2) to secure connectors of a second size 206(4). In an implementation, the size of chassis 218 may not permit connectors 206 of beyond a certain length to be secured perpendicular to the rear connection bar. Thus, as depicted in FIG. 2D, the second size connectors 206(6) may be secured angularly such that they are not substantially perpendicular to the rear connection bar 202. In this way, terminal block 108(2) may receive connectors 206 of different sizes with a rear connection bar 202 in a single position 204(6).

Taken together FIGS. 2A to 2D depict configurations in which a rear connection bar 202 is utilized in terminal blocks 108(1) and 108(2) having different sizes to secure at least two sizes of connectors (e.g., connectors 206(2) and 206(4)) in both terminal blocks.

FIG. 2E depicts a schematic representation of the rear connection bar 202 in the various configurations described with respect to FIGS. 2A to 2D and showing mounting patterns for connectors 206. FIG. 2E further illustrates that the rear connection bar 202 is connectable within different sized terminal blocks to secure different sized connectors. Depicted are four exemplary configurations showing rear connection bar 202 connected in two positions (e.g. positions 204(2) and 204(4)) within a first terminal block 108(1) to secure two sizes of connectors respectively (e.g. connectors 206(2) and 206(4)) and connected in a single position (position 204(6)) within a second terminal block 108(2), to secure two sizes of connectors. Thus, rear connection bar 202 may be utilized in at least four configurations to secure at least two sizes of connectors in two sizes of terminal blocks.

FIGS. 3A to 3F depict various views of another exemplary rear connection bar 302 which may be utilized to secure different size connectors, in a terminal block.

Figure 3A:
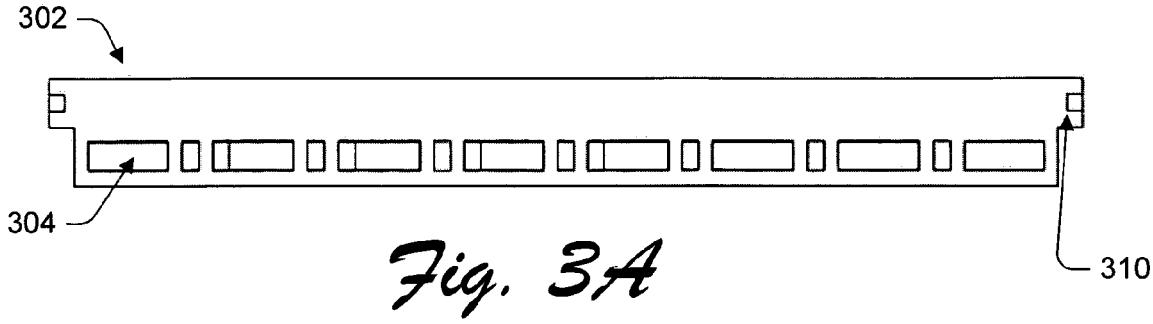
FIGS. 3A to 3F illustrate another exemplary rear connection bar in detail from different respective views.

FIG. 3A depicts a front on view of exemplary rear connection bar 302. Rear connection bar 302 has a plurality of rectangular slots 304, to receive mounting ends of connectors (e.g., connectors 206 described previously). The slots 304 are configured to receive connectors 206 such that they may be secured substantially perpendicular to the rear connection bar. The slots 304 may be rectangular cut out portions of rear connection bar 304. The slots 304 may run entirely through the body of rear connection bar 304 or only partially into the body.

Figure 3B:
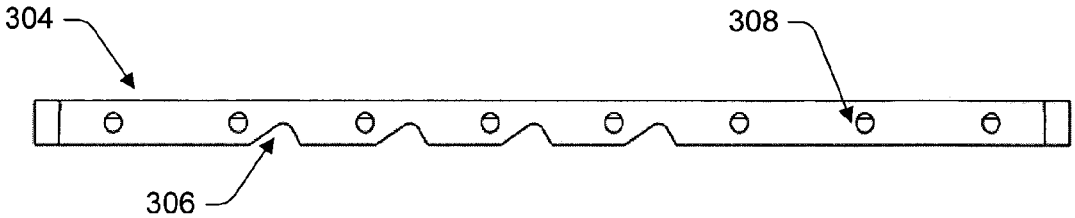

FIG. 3B depicts rear connection bar 302 of FIG. 3A rotated 90 degrees upward. In this view a plurality of notches 306 are depicted in rear connection bar 302. The notches 306 are configured to receive connectors such that they may be secured when not substantially perpendicular to the rear connection bar. Notches are formed into portions of rear connection bar 302 to permit a connector 206 to be mounted angularly without interference from the body of the rear connection bar 302. Without the notches, angular positioning of a connector 206 may be inhibited by the body of the rear connection bar 302.

A plurality of mounting holes 308 are also shown in FIG. 3B. Mounting holes 308 run through rear connection bar 302 and align with a corresponding hole in the end of a connector 206 when the connector 206 is inserted into either a slot or a notch of connection bar 302. A fastener, such as a screw, rivet, clip, pin and so forth may be inserted through the mounting hole and connector 206, to secure the connector 206 to the rear connection bar.

Figure 3C:
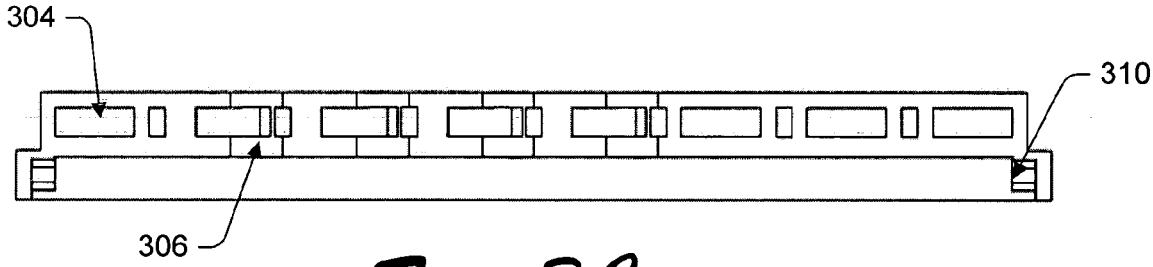

FIG. 3C depicts rear connection bar 302 of FIG. 3A rotated 180 degrees upward. FIG. 3C shows a front on view of notches 306. Four notches are depicted in both FIGS. 3B and 3C. Naturally, other implementation may have more or less notches. As best depicted in FIG. 3C, notches 306 are located opposite some of slots 304.

Figure 3D:
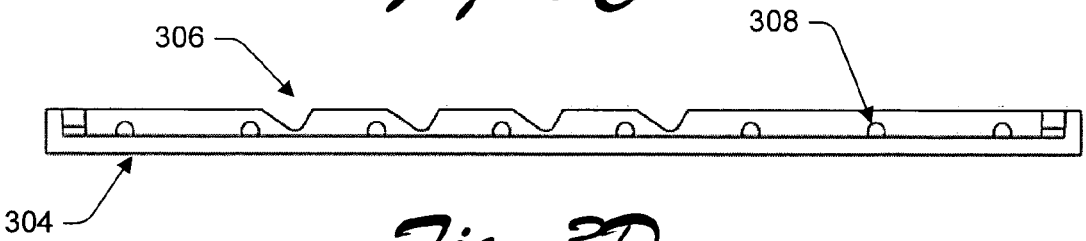

FIG. 3D depicts rear connection bar 302 of FIG. 3A rotated 270 degrees upward. This view again shows the plurality of notches 306 and the plurality of mounting holes 308 as seen from the opposite side of the rear connection bar 302 from that depicted in FIG. 3B.

Figure 3E:
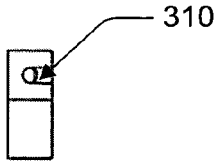
Figure 3F:
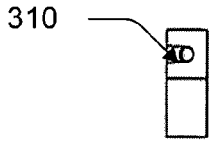

FIGS. 3E and 3F show end views of rear connection bar 302 depicted in FIG. 3A. Each end of rear connection bar 302 has a connection hole 310 to connect the connection bar 302 to a chassis of a terminal block. Each position within the chassis of a terminal block may have a corresponding hole. Accordingly, a fastener such as a screw, pin, clip, rivet and so forth may be used to connect the rear connection bar 302 to a terminal block using the connection holes 310 on each end. In other implementations, other fastening means may be employed, such as those described in reference to rear connection bar 202 above.

Figure 4A:
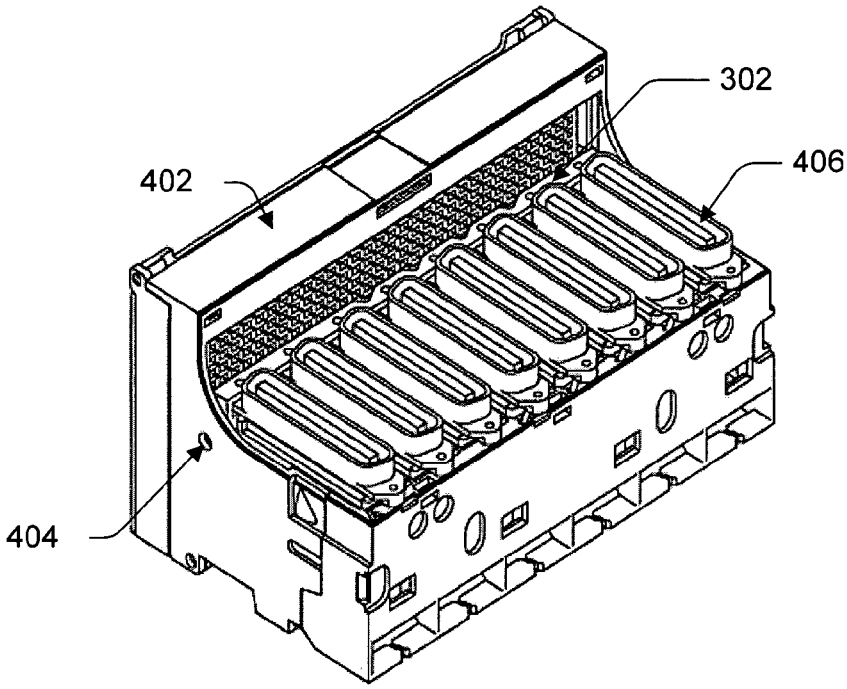
FIGS. 4A to 4D illustrate the exemplary rear connection bar depicted in FIGS. 3A–3F connected in exemplary terminal blocks to secure at least two sizes of connectors in each terminal block.
Figure 4B:
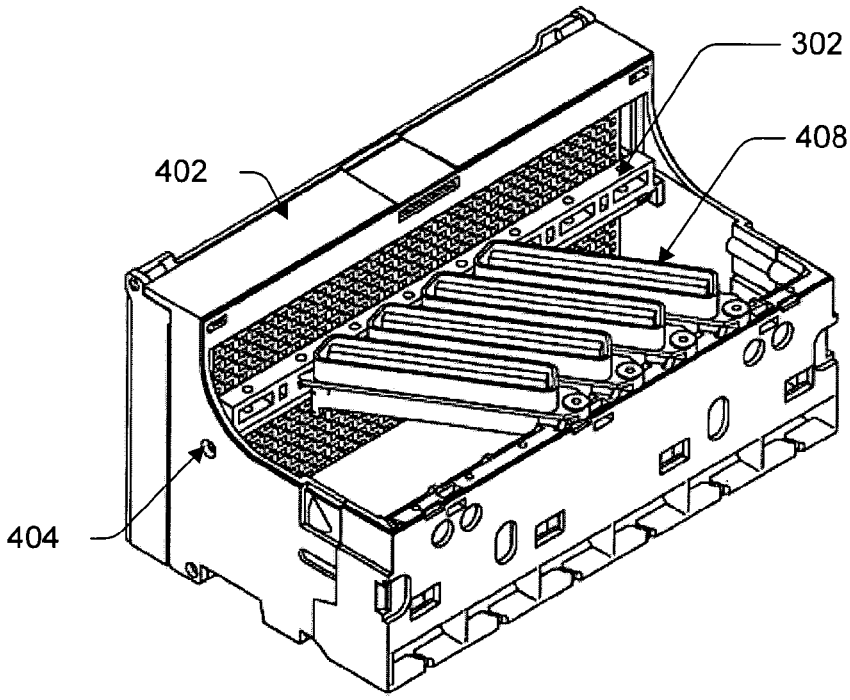

FIGS. 4A to 4D depict rear connection bar 302 utilized to secure different connectors in four different configurations within exemplary terminal blocks. An exemplary terminal block 402 is depicted in FIGS. 4A and 4B, in which, rear connection bar 302 is connected at a location 404 within the chassis of terminal block 402. For example, rear connection bar 302 may be connected to terminal block 402 using the connection holes 310 on each end of the rear connection bar 302. The chassis of terminal block 402 has a corresponding hole to permit a fastener to run through the chassis and into the connection holes 310. Thus, rear connection bar may be removably connected to terminal block 402 using removable fasteners such as screws, clips, pins, rivets and so forth.

In FIG. 4A a plurality of connectors 406 are depicted. An end of each connector 406 is inserted into a slot 304 of rear connection bar 302. The end has a hole corresponding to a mounting hole 308 of rear connection bar 302. Thus, connectors 406 may be secured to rear connection bar 302 via a fastener. The other end of the connectors 406 as depicted is secured to the terminal block 402. It is noted that in FIG. 4A, the rear connection bar 302 is connected to terminal block 402 such that the face shown in FIG. 3A receives the end of connectors 406. In other words, the slots 304 of FIG. 3A are toward the connectors 406 and the notches 306 of FIG. 3C are on the opposite side (e.g, away from the connectors 406). Thus, in FIG. 4A a plurality of connectors 406 are secured to terminal block 402. The slots 304 in rear connection bar support the connectors 406 and secure the connectors substantially perpendicular to the rear connection bar 302.

In FIG. 4B a plurality of connectors 408 are depicted. Connectors 408 are longer than the connectors 406 depicted in FIG. 4A. Thus, as shown in FIG. 4B, connectors 408 are angularly secured to terminal block 402, such that they are not substantially perpendicular to the rear connection bar 302. It is further noted that in FIG. 4B, the rear connection bar 302 has been reversed from FIG. 4A such that the notches 306 of FIG. 3C are now towards connectors 408. As discussed, the notches 306 permit longer connectors 408 to be secured to the rear connection bar. A portion of the body of connectors 408 fits into the notches 306 in rear connection bar 302. In this manner, an end of connector 408 may be inserted into rear connection bar 302 at an angle and may be secured via a fastener in a mounting hole 308. Connectors may be secured in the ways previously described in reference to connectors 406 of FIG. 4B.

Thus, rear connection bar 302 is reversible to secure connectors 406 in a terminal block such as terminal block 402 substantially perpendicular to the rear connection bar 302 in one orientation and when in reverse orientation (e.g., reversed end to end), to secure different sized connectors 408 in the terminal block such that they are not substantially perpendicular to the rear connection bar 302. In each case, reversed or not, the rear connection bar 302 is connected in the same position 404 within chassis of terminal block 402.

Figure 4C:
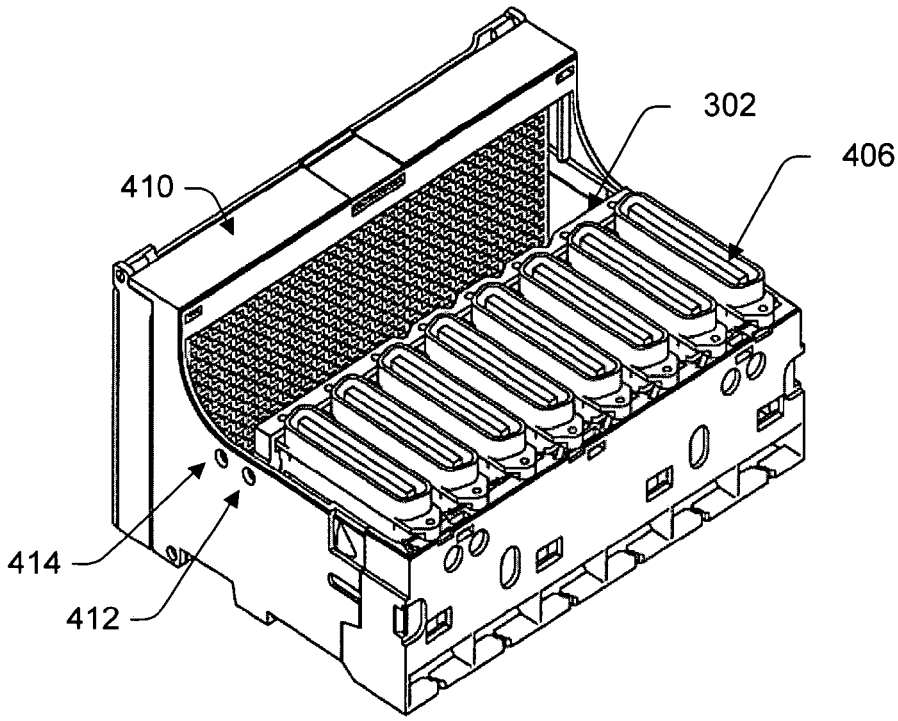
Figure 4D:
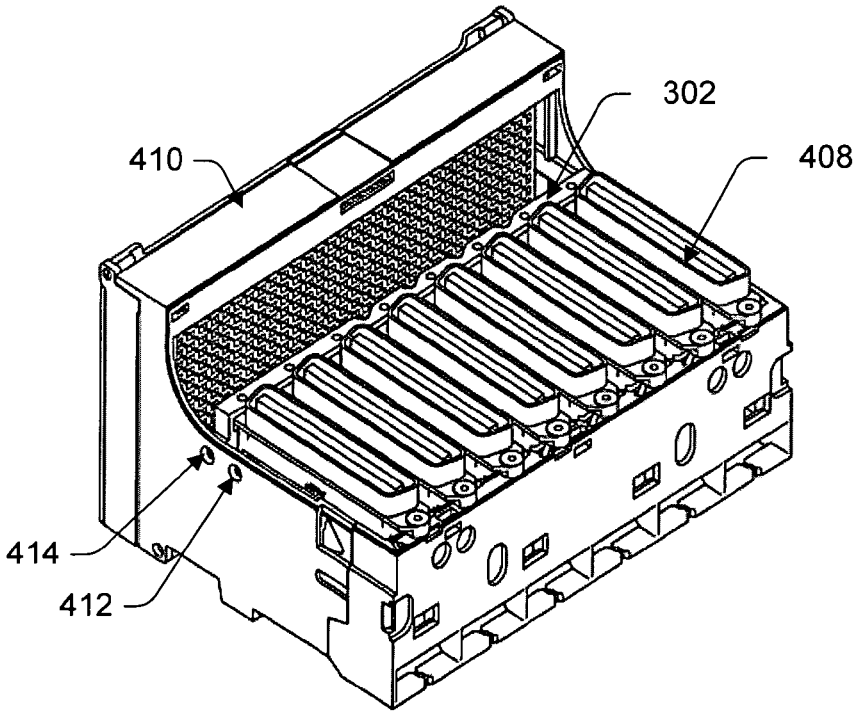

FIGS. 4C and 4D depict another exemplary terminal block 410 in which the rear connection bar 302 may be employed. Terminal block 410 is a larger sized terminal block than terminal block 402 depicted in FIGS. 4A and 4B. For instance, terminal block 402 may be a 4.75 inch terminal block and terminal block 410 may be a 6.00 inch terminal block. The size of the terminal block 410 refers to the nominal size of the block and may correspond to the size of cabinet (e.g., rack or distribution frame) in which the terminal block 410 may be mounted. Thus, the actual size of a terminal block 410 may vary slightly from the nominal size.

Terminal block 410 has two positions, position 412 and position 414 within the chassis where rear connection bar 302 may be connected. In FIG. 4C, rear connection bar 302 is connected at position 412 to secure a plurality of connectors 406. In FIG. 4D, the rear connection bar has been moved to position 414 to secure larger sized connectors 408. Connectors 406 and 408 may be secured to terminal block 410 in the same manner described in reference to connectors 406 secured in terminal block 402 of FIG. 4A. Thus, terminal block 410 may utilize rear connection bar 302 to secure different sized connector (e.g., connectors 406 and 408).

FIGS. 4A to 4D together illustrate rear connection bar 302 utilized to secure at least two different size connectors in at least two different sized terminal blocks. In one implementation, the terminal blocks 402 and 410 are size 4.75 and 6.00 inch terminal blocks respectively. Further in the one implementation connectors 406 and 408 are 50 pin and 64 pin connectors, respectively.

Figure 5:
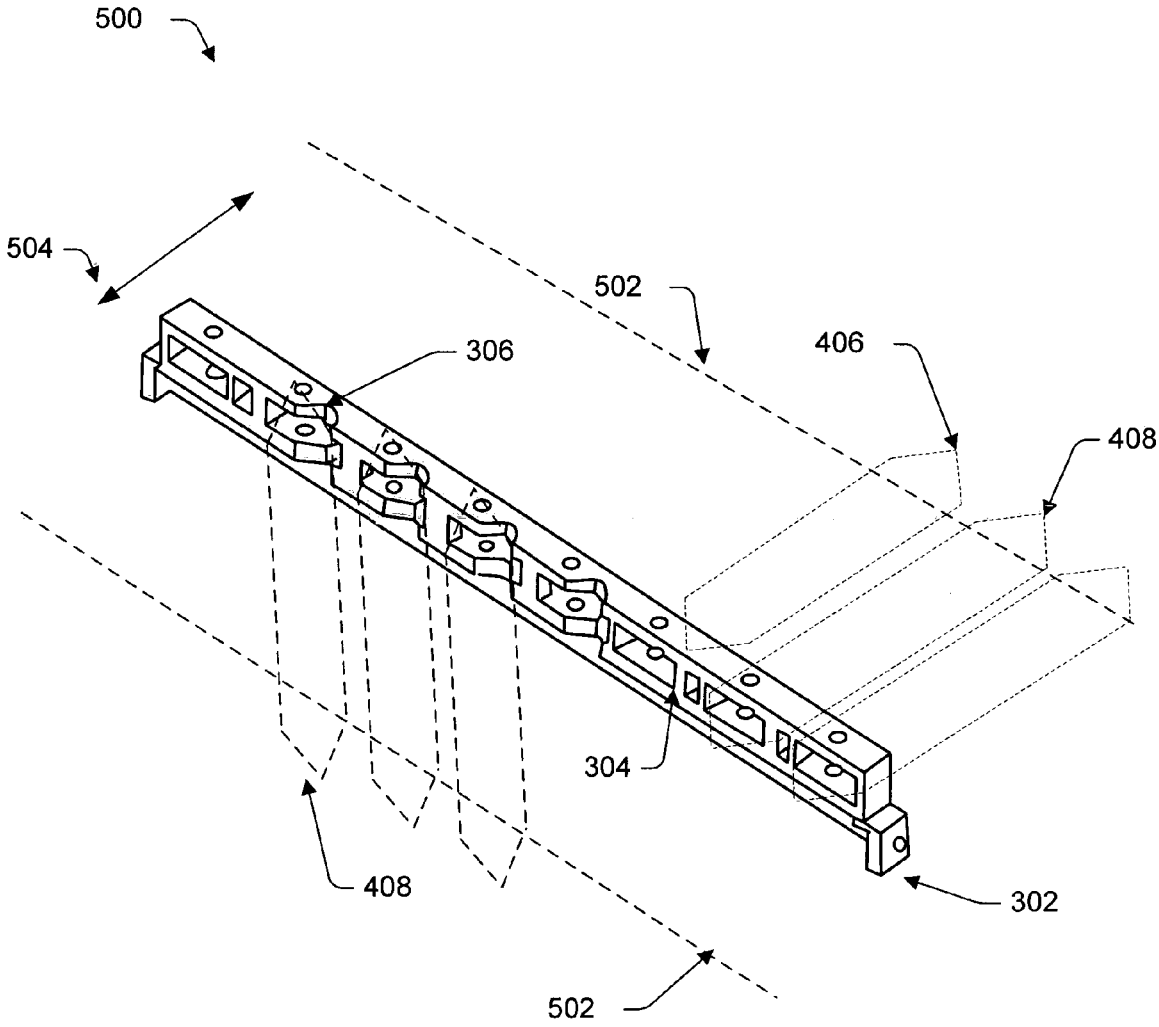
FIG. 5 illustrates of a perspective view of the rear connection bar depicted in FIGS. 3A to 3F showing mounting patterns for different connectors.

FIG. 5 depicts a perspective view of rear connection bar 302 further illustrating mounting patterns for connectors utilizing two sides of the connection bar 302. On one side, the slots 304 permit connectors to be secured straight or substantially perpendicular. FIGS. 4A, 4C and 4D depict connectors secured in this way. On the opposite side having notches 306, connectors may be secured angularly, e.g., are not substantially perpendicular. FIG. 4B depicts connectors secured in this way.

The dashed line 502 represents the terminal block chassis to which the other end (e.g., the end not secured to the rear connection bar) may be secured. Two lines 502 are shown to represent that the rear connection bar 302 is used in a first orientation to secure connectors straight or substantially perpendicular, and in reverse orientation (reversed end to end) to secure connectors angularly or not substantially perpendicular, relative the rear connection bar 302. The arrow 504 represents that the rear connection bar 302 may be connected in a plurality of positions within a chassis of a terminal block to accommodate different size connectors.

Exemplary Procedures

The following discussion describes techniques that may be implemented utilizing the previously described systems and devices. The procedures are shown as a set of blocks that specify operations performed and are not necessarily limited to the orders shown for performing the operations by the respective blocks.

Figure 6:
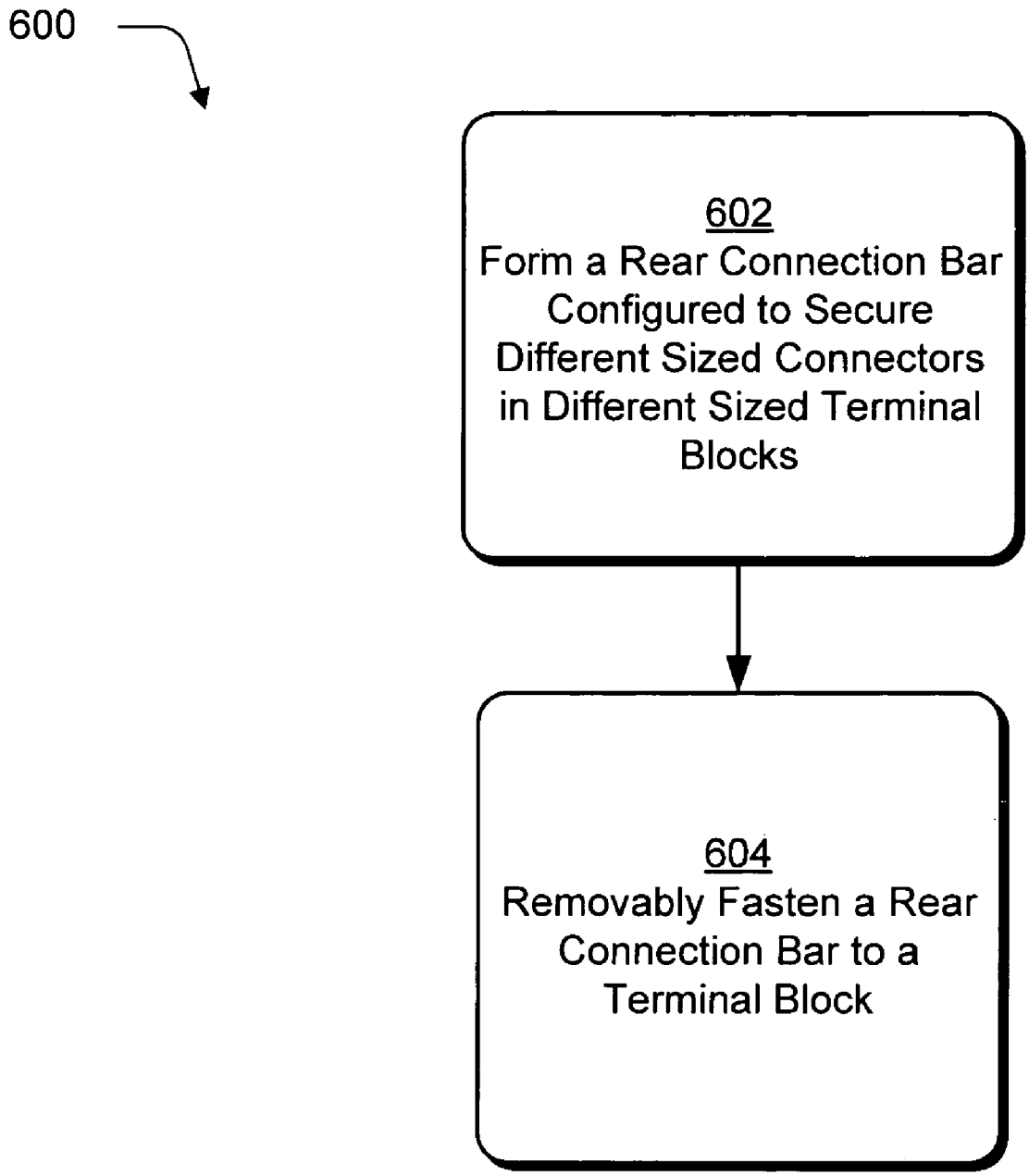
FIG. 6 is a flow diagram depicting the forming a terminal block having a rear connection bar.

FIG. 6 is a flow diagram depicting a procedure 600 in an exemplary implementation in which a rear connection bar is utilized to secure connectors in a plurality of terminal blocks. A rear connection bar is formed configured to secure different size connectors in different sized terminal blocks (block 602). For example, the rear connection bar 302 depicted in FIGS. 3A to 3F may be formed. Rear connection bar 302 is formed having a plurality of slots 304 and a plurality of notches 306. The rear connection bar 302 is connectable to a different-sized terminal blocks (e.g., terminal blocks 402 and 410 of FIGS. 4A to 4D) to secure different sized connectors (e.g. connectors 406 and 408 of FIGS. 4A to 4D).

The rear connection bar 302 is then removably fastened to a terminal block (block 604). Again using rear connection bar 302 as an example, rear connection bar 302 may be connected to terminal block 402 depicted in FIG. 4A at position 404. For instance, a screw may be used to fasten the rear connection bar 302 using a connection hole 310 on each end of the rear connection bar. At each end, a screw is inserted through a corresponding hole in the chassis of terminal block 402 and into a connection hole 310 of the rear connection bar 302. Thereby the rear connection bar 302 is connected to terminal block 402. The screws may there after be withdrawn to permit removal of the rear connection bar 302. Rear connection bar 302 may then be connected in different positions and orientations within different terminal blocks to accommodate different sizes of connectors.

CONCLUSION

Although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention.

What is claimed is:

1. A terminal block comprising:

a chassis; and a rear connection bar connectable to the chassis to arrange at least two sizes of connectors, the rear connection bar having:

a plurality of slots disposed upon a first surface; and a plurality of notches disposed upon a second surface opposite the first surface, wherein the rear connection bar is:

connectable to the chassis in a first orientation at a position to arrange connectors having a first said size using said slots, such that the connectors are substantially perpendicular to the rear connection bar; and connectable to the chassis in reverse orientation at the position to arrange connectors having a second said size using said notches, such that the connectors are not substantially perpendicular to the rear connection bar.

2. An terminal block as recited in claim 1, wherein:

the first said connectors are 50 pin connectors, and the second said connectors are 64 pin connectors.

3. A terminal block as recited in claim 1 wherein the terminal block is a 4.75 inch terminal block.

4. A terminal block as recited in claim 1 wherein the rear connection bar is:

connectable to a larger terminal block at one location to arrange connectors having the first said size using said slots, such that the connectors are substantially perpendicular to the rear connection bar; and connectable to the larger terminal block at another location to arrange connectors having the second said size using said slots, such that the connectors are substantially perpendicular to the rear connection bar.

5. A terminal block as recited in claim 1 further comprising a plurality of connection holes disposed upon the rear connection bar wherein each connector hole is configured to be aligned with one end of a connector and to receive a fastener to secure the connector.

6. A rear connection bar configured to be connectable in one or more positions within each of a first terminal block and a second terminal block wherein:

the first terminal block is a different size than the second terminal block; and the rear connection bar is configured to secure at least two sizes of connectors while connected to each said terminal block, with one size connector substantially perpendicular to the rear connector bar and a second size connection bar substantially non-perpendicular to the rear connection bar, and the rear connection bar includes a plurality of connection holes disposed upon the rear connection bar wherein each connector hole is configured to be aligned with one end of a connector and to receive a fastener to secure the connector.

7. A rear connection bar as recited in claim 6 wherein the first terminal block is a 4.75 inch terminal block and the second terminal block is a 6.00 inch terminal block.

8. A rear connection bar as recited in claim 6 wherein the at least two sizes of connectors include 50 pin connectors and 64 pin connectors, respectively.

9. The rear connection bar recited in claim 6 wherein:

the rear connection bar is removably connectable in a first position within the first terminal block to secure a plurality of 50 pin connectors substantially perpendicular to the rear connection bar; and the rear connection bar is connectable in a second position within the first terminal block to secure a plurality of 64 pin connectors substantially perpendicular to the rear connection bar.

10. The rear connection bar recited in claim 9 wherein:

the rear connection bar is reversibly connectable in a first position within the second terminal block such that in one orientation a plurality of 50 pin connectors are securable substantially perpendicular to the rear connection bar; and in reverse orientation a plurality of 64 pin connectors are securable such that the connectors are not substantially perpendicular to the rear connection bar.

11. A terminal block comprising:

a chassis; and a rear connection bar connectable to the chassis to arrange at least two sizes of connectors, the rear connection bar having:

a plurality of slots disposed upon a first surface; and a plurality of notches disposed upon a second surface opposite the first surface, wherein the rear connection bar is:

connectable to the chassis at a position to arrange connectors having a first said size using said slots, such that the connectors are substantially perpendicular to the rear connection bar; and connectable to the chassis at another position to arrange connectors having a second said size using said slots, such that the connectors are substantially perpendicular to the rear connection bar.

12. A terminal block as recited in claim 11, wherein the terminal block is a 6.00 inch terminal block.

13. A terminal block as recited in claim 11, wherein the rear connection bar is:

connectable to a smaller terminal block in a first orientation at one location to arrange connectors having the first said size using said slots, such that the connectors are substantially perpendicular to the rear connection bar; and connectable to the smaller terminal block in reverse orientation at the one location to arrange connectors having the second said size using said notches, such that the connectors are not substantially perpendicular to the rear connection bar.

* * * * *